US010955094B2

(12) United States Patent
Brennan

(10) Patent No.: US 10,955,094 B2
(45) Date of Patent: Mar. 23, 2021

(54) TIKI TORCH HOLDER KIT

(71) Applicant: Patrick Kelly Brennan, Bradenton, FL (US)

(72) Inventor: Patrick Kelly Brennan, Bradenton, FL (US)

( * ) Notice: Subject to any disclaimer, the term of this patent is extended or adjusted under 35 U.S.C. 154(b) by 0 days.

(21) Appl. No.: 16/564,379

(22) Filed: Sep. 9, 2019

(65) Prior Publication Data

US 2020/0003373 A1 Jan. 2, 2020

Related U.S. Application Data

(63) Continuation-in-part of application No. 15/692,168, filed on Aug. 31, 2017, now Pat. No. 10,408,439.

(51) Int. Cl.
*F21L 17/00* (2006.01)
*F21V 21/08* (2006.01)

(52) U.S. Cl.
CPC ..... *F21L 17/00* (2013.01); *F21V 21/0824* (2013.01)

(58) Field of Classification Search
CPC .... F21L 17/00; F21V 21/0824; F21V 17/007; F21V 17/04; F21V 17/06; F21V 17/08; F21V 17/10; E04H 12/22; E04H 12/2223; E04H 12/2253; E04H 12/2276; E04H 12/2284; F21S 8/081
USPC ..... 362/190, 191
See application file for complete search history.

(56) References Cited

U.S. PATENT DOCUMENTS 10,408,439 B2 * 9/2019 Brennan ..... E04H 12/2215

* cited by examiner

*Primary Examiner* — Suezu Ellis
(74) *Attorney, Agent, or Firm* — Dunlap Bennett & Ludwig, PLLC

(57) ABSTRACT

A kit of garden torch holders for securely retaining a garden torch in the ground and on the wall is provided. An in-use torch holder has a hollow body having a circumferential flange and a hollow tip for planting the first torch holder into the ground for retaining a shaft therein. The kit also provides wall mountable upward, lateral or rack torch holders providing pairs of opposing notches for mounting both the body of the garden torch and the above mentioned in-use torch holder.

4 Claims, 6 Drawing Sheets

TIKI TORCH HOLDER KIT

CROSS-REFERENCE TO RELATED APPLICATION

This application claims the benefit of priority of U.S. Non-provisional application Ser. No. 15/692,168, filed 31 Aug. 2017, the contents of which are herein incorporated by reference.

BACKGROUND OF THE INVENTION

The present invention relates to garden torches and, more particularly, to a kit of garden torch holders that securely hold garden torch poles in the ground, wherein each kit of garden torch holders may be wall mountable for off-season use or storage.

Garden torches, sometimes called tiki torches, are used for nighttime illumination of outdoor spaces, such as gardens. Such torches are typically elevated several feet above the ground level by a shaft. These shafts, however, are sometimes difficult to push into hard soil so that the garden torch stands straight. Likewise, when the ground gets wet it may adversely affect the ability of the torch to stand upright. Relatedly, traditional garden torch shafts can be difficult to pullout from soil either to relocate the garden torch or for storage purposes. Additionally, the elongated nature of garden torches makes them difficult to store in the off-season.

Currently, there are stands for garden torches, but these have several disadvantages including, but not limited to, requiring metal screws to attach the base to the shaft. Also, adapting only one side of the stand for securement to the ground causing bending and stability issues upon planting and keeping the garden torch upright during heavy winds. Furthermore, because of these structural limitations, the use of metal screws and one-sided staking, most if not all of the current devices need to be made of metal, which are susceptible to rust.

As can be seen, there is a need for a garden torch holder that repeatedly enables a stable connection and disconnection between the shaft and the ground, be the ground softer sandy soils, wet soil, or any type of soil. The garden torch holder of the present invention is adapted to hold the garden torch completely around the base of the shaft, not just along one side. Thereby, the garden torch holder embodied by the present invention facilitates the planting into and the pulling out of the ground, and does not require a screw to be turned at ground level to secure the torch to the holder/stand.

SUMMARY OF THE INVENTION

In one aspect of the present invention, a first torch holder includes a hollow cylindrical portion extending from a flange end to a tip end, wherein the flange end defines an opening communicating to the hollow of the hollow cylindrical portion; a flange radially extending from the flange end; a hollow conical tip portion extending from said tip end along a longitudinal axis shared with the cylindrical portion; and a plurality of ribs protruding from an inward surface of said conical tip portion, wherein the plurality of ribs is spaced apart along the inward surface thereof for frictionally engaging and supporting a shaft of a torch in an upright orientation.

In another aspect of the present invention, the torch holder provides the following: a hollow cylindrical portion extending from a flange end to a tip end, wherein the flange end defines an opening communicating to the hollow of the hollow cylindrical portion; a flange radially extending from the flange end; the hollow cylindrical portion having an edge point, the edge point being approximately midpoint between the flange end and the tip end; and a void of the cylindrical portion defined by an angled edge extending from the edge point to the tip end, wherein the approximate midpoint is between forty and sixty percent between the flange and tip ends.

In yet another aspect of the present invention, the torch holder provides the following: a hollow cylindrical portion extending from a flange end to a tip end, wherein the flange end defines an opening communicating to the hollow of the hollow cylindrical portion; a flange radially extending from the flange end; a hollow tapered portion extending inwardly from the tip end of the hollow cylindrical portion so that the hollows of the cylindrical and tapered portions communicate; a spike extending from a distal end of the hollow tapered portion along a longitudinal axis shared by the hollow cylindrical portion and the hollow tapered portion from said tip end along a longitudinal axis shared with the cylindrical portion; a drain hole in the hollow tapered portion that fluidly communicates to said hollows; and a plurality of spaced apart longitudinal flanges along said spike.

In yet another aspect of the present invention, a kit for holding garden torches in a vertical supporting surface and a horizontal supporting surface includes the first torch holder; and a upward torch holder providing: a upward mounting portion; at least one pair of upward notch arms extending from the upward mounting portion, each upward notch arm providing at least two spaced apart upward notches so that each pair of upward notch arms provides a plurality of pairs of upward notches, wherein each pair of upward notches is dimensioned to slidably receive a conical base portion of a garden torch; a retainer arm extending from said mounting portion; and a plurality of protrusions extending upwardly from the retainer arm.

In yet another aspect of the present invention, a kit for holding garden torches in a vertical supporting surface and a horizontal supporting surface includes lateral torch holder providing: a lateral mounting portion; a plurality of pairs of lateral notch arms extending from the lateral mounting portion, each lateral notch arm providing an upper flange perpendicularly extending from an upper portion thereof; and each upper flange providing a plurality of lateral notches so that each pair of lateral notch arms provides a plurality of pairs of facing lateral notches.

In yet another aspect of the present invention, a kit for holding garden torches in a vertical supporting surface and a horizontal supporting surface includes the following: a rack torch holder providing the following: a mounting portion; a plurality of rack arms extending from the mounting portion; a top plate perpendicularly joined along a top portion of each rack arm; a first void in the top plate between adjacent rack arms; the first void provides inward-facing, spaced-apart stake holding nubs so as to define a plurality of slots; and a plurality of torch slots provided along the top plate that extends not between adjacent rack arms, wherein the torch slots are dimensioned to slidably receive a conical base portion of a garden torch, wherein each torch slot is defined by two spaced apart lateral supports; and an upward-facing torch holding nub a distal end of each lateral support, wherein a top portion of the mounting component provides a hanger plate.

These and other features, aspects and advantages of the present invention will become better understood with reference to the following drawings, description and claims.

DETAILED DESCRIPTION OF THE INVENTION

Figure 1:
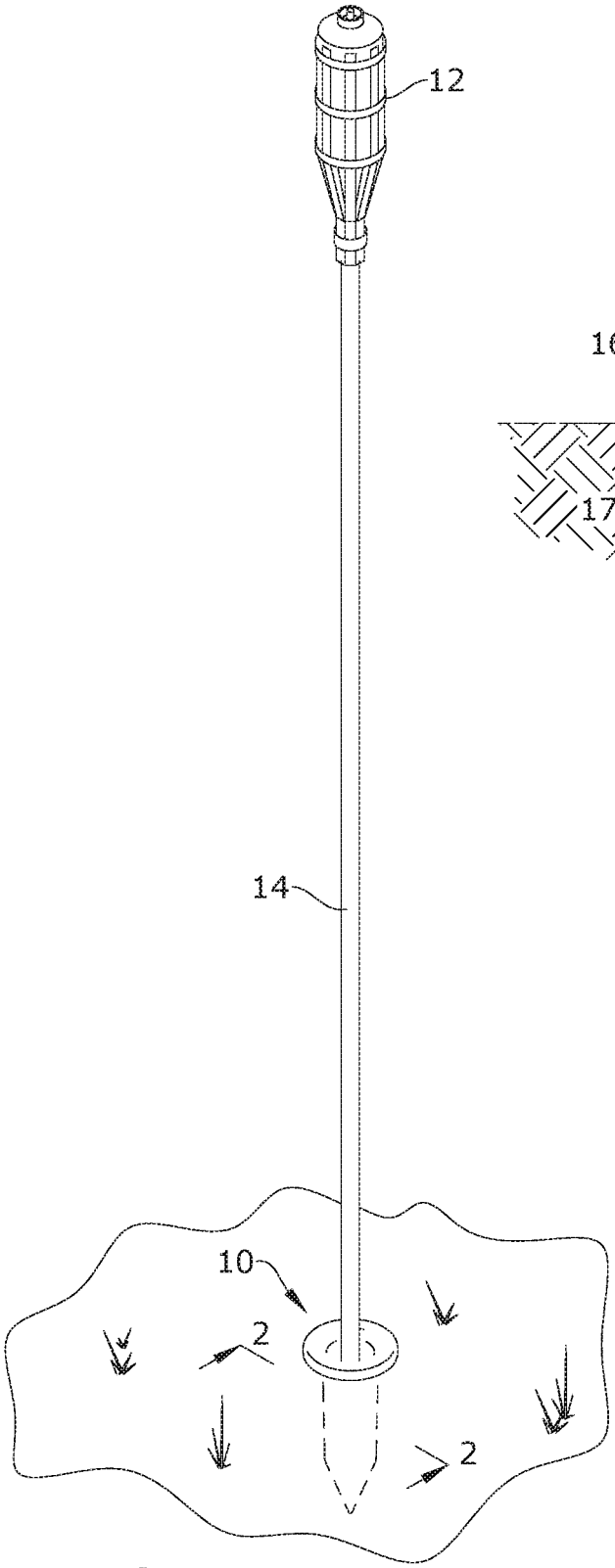
FIG. 1 is a perspective view of an exemplary embodiment of an in-use torch holder of the present invention, shown in use.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a kit of garden torch holders for securely retaining a garden torch in the ground during and separately on the wall during non-use/storage. The in-use torch holder has a hollow body having a circumferential flange and a hollow tip for planting the first torch holder into the ground for retaining a shaft therein. The kit also provides wall mountable storage torch holders providing pairs of opposing notches for mounting both the body of the garden torch and the above mentioned in-use torch holder.

It should be understood by those skilled in the art that the use of directional terms such as upper, lower, upward, downwardly, inward, inner and the like are used in relation to the illustrative embodiments as they are depicted in the figures, the upward direction (or upper) being toward the top of the corresponding figures and a downward direction being toward the bottom of the corresponding figure.

Referring to FIGS. 1 through 6, the present invention may include a first in-use torch holder 10 for removably securing a garden torch 12 via its shaft 14 to a horizontal supporting surface 40, such as the ground. the present invention also may embody an upward and lateral storage torch holder 24 and 32 for removably securing the garden torch 12 via its base 50 to a vertical supporting surface 42, such as a wall. Each holder 10, 24, and 32 may be made of material that can be repeatedly bent without fracturing and is not susceptible to rusting, such as various plasticized materials and the like that can be fabricated via injection molding, additive manufacture and the like.

Figure 2:
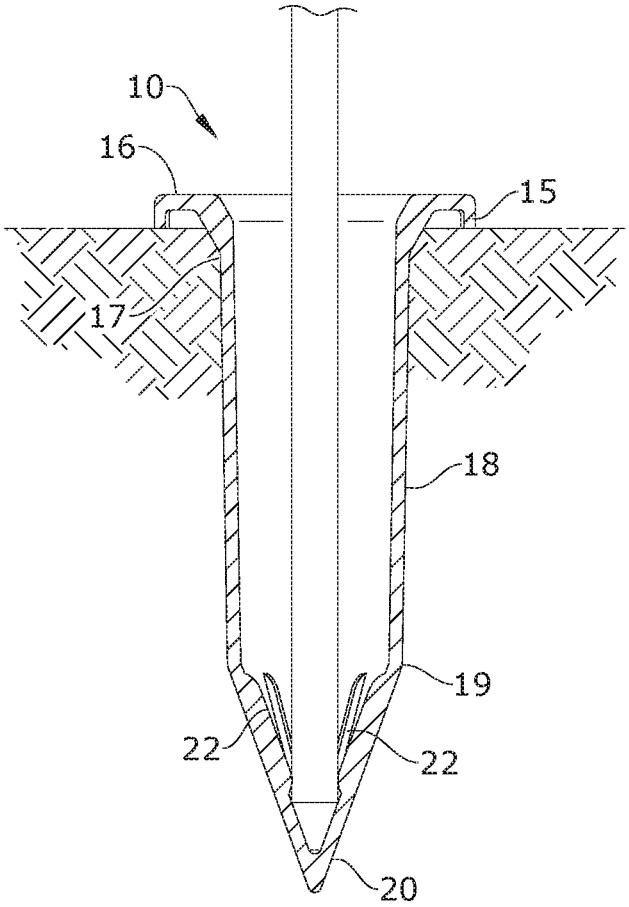
FIG. 2 is a cross-sectional view of an exemplary embodiment of the in-use torch holder of the present invention taken along line 2-2 of FIG. 1.

The in-use torch holder 10 may have a hollow cylindrical portion 18 that extends between a flange end 17 to a tip end 19. A flange 16 may radially extend from a circumference of the flange end 17. The flange 16 provides a surface area for a user to apply downward pressure along the first torch holder 10 for submerging it into the horizontal supporting surface 40, while still maintaining an opening 44 communicating to the hollow of the cylindrical portion 18. The flange 16 may provide a flange ridge 15 for engaging the horizontal supporting surface 40 when the remaining portions of the first torch holder 10 have penetrated said horizontal supporting surface 40. The flange ridge 15 may extend perpendicularly from a distal end of the flange 16, as illustrated in FIG. 2.

A hollow conic tip 20 may extend from the tip end 18 along a shared longitudinal axis of the conic tip 20 and the cylindrical portion 18, wherein the conic tip 20 is adapted to penetrate the horizontal supporting surface 40. The conic tip 20 may provide inward-facing ribs 22 protruding into its hollow space, wherein the ribs 22 are adapted to frictionally engage the surface of the shaft 14 slid into the hollow space, as illustrated in FIG. 2.

In another embodiment, a second in-use torch holder 90 may have a flange 52 may radially extend from the circumference of the flange end of the second in-use torch holder 90. Said flange end also provides an opening 58 communicating to the hollow of the cylindrical portion 54, though the cylindrical portion 54 is defined by an angled edge 56 extending from an edge point 59 between forty to sixty percent from flange end relative to the tip end 61. The angled edge 56 is a void or cutout from the otherwise cylindrical portion 54, thereby defining a tip portion 57.

In another embodiment, a third in-use torch holder 60 may have a flange 62 may radially extend from the circumference of the flange end of the second in-use torch holder 60. Said flange end also provides an opening 68 communicating to the hollow of the cylindrical portion 64. The distal end of the cylindrical portion 64 provides a tapered portion 67 that tapers inward relative to the cylindrical portion 64. the distal end of the tapered portion provides a spike 66 extending away therefrom along a longitudinal axis shared by the cylindrical portion 64 and the tapered portion 67. The spike 66 may provide longitudinal flanges 71.

The tapered portion 67 may be hollow, defining a drain space communicating with the hollow space of the cylindrical portion 64. The tapered portion 67 may provide a drain hole 69 fluidly communicating with said drain space so that if water, such as rainwater or sprinkler water, filled the hollow of the cylindrical portion 64, it would evacuate through the drain hole 69 so as not to less the grip of the third in-use torch holder 60 and associated shaft (or possibly freeze overnight so as to damage the cylindrical portion 64).

Figure 4:
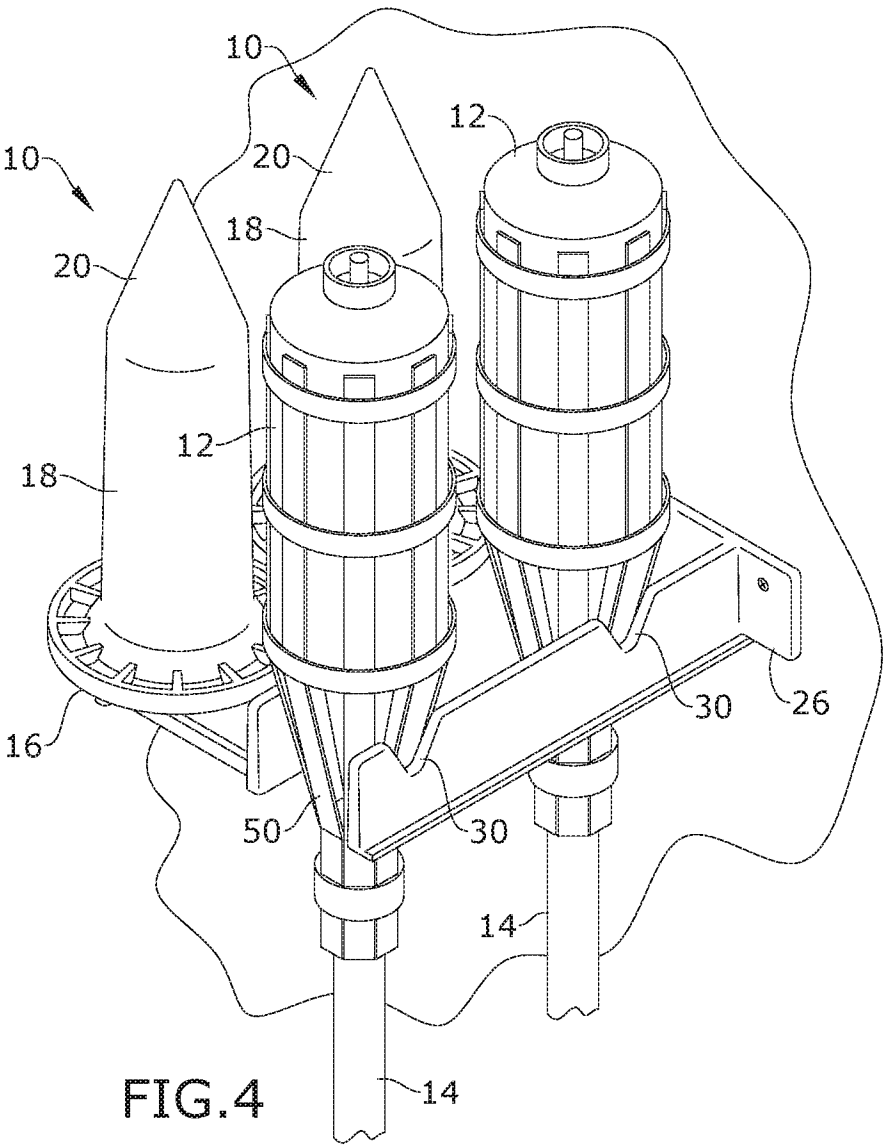
FIG. 4 is a perspective view of an exemplary embodiment of the present invention, showing the upward storage holder in use.
Figure 3:
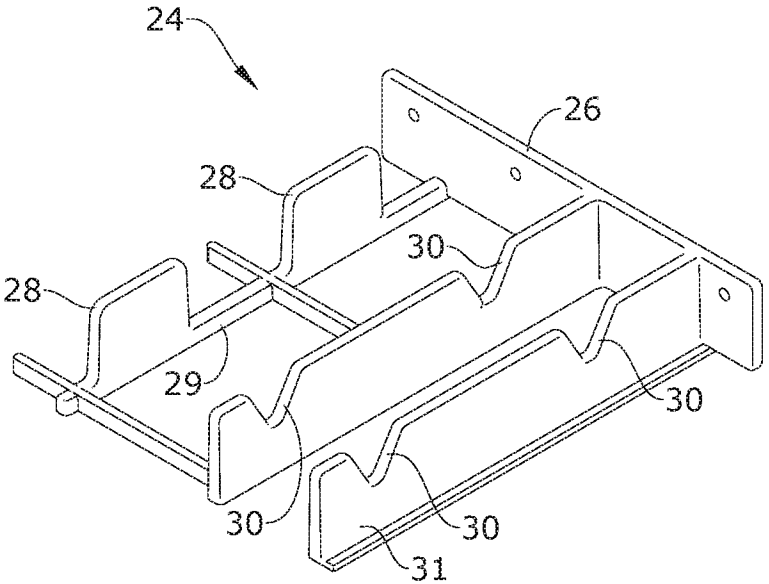
FIG. 3 is a perspective view of an exemplary embodiment of an upward storage torch holder of the present invention.

The upward and lateral torch holder 24 and 32 may provide a planar mounting component 26 and 36, respectively, adapted to mount to the vertical supporting surface 42; in certain instances, by providing fastener holes or the like. the upward torch holder 24 may provide a plurality of notch arms 31 and retainer arms 29 extending generally perpendicularly from the planar mounting component 26, as illustrated in FIG. 3. Each notch arm 31 may provide a plurality of spaced apart V- or U-shaped upward-facing notches 30 cut into each arm 31 so that the notches 30 align with notches 30 on an adjacent arm 31. Thereby these pairs of aligned upward-facing notches 30 are dimensioned and adapted to engage opposing sides of a conic base 50 of the torch 12 for removably retaining said torch 12 in a stored condition, as illustrated in FIG. 4. Each retainer arm 29 provides a plurality of spaced apart of protrusions 28, each protrusion 28 may be dimensioned and adapted to slide into the opening 44 and snugly engage the inner walls of the cylindrical portion 18, retaining the first torch holder 10 in a stored condition, as illustrated in FIG. 4.

Figure 6:
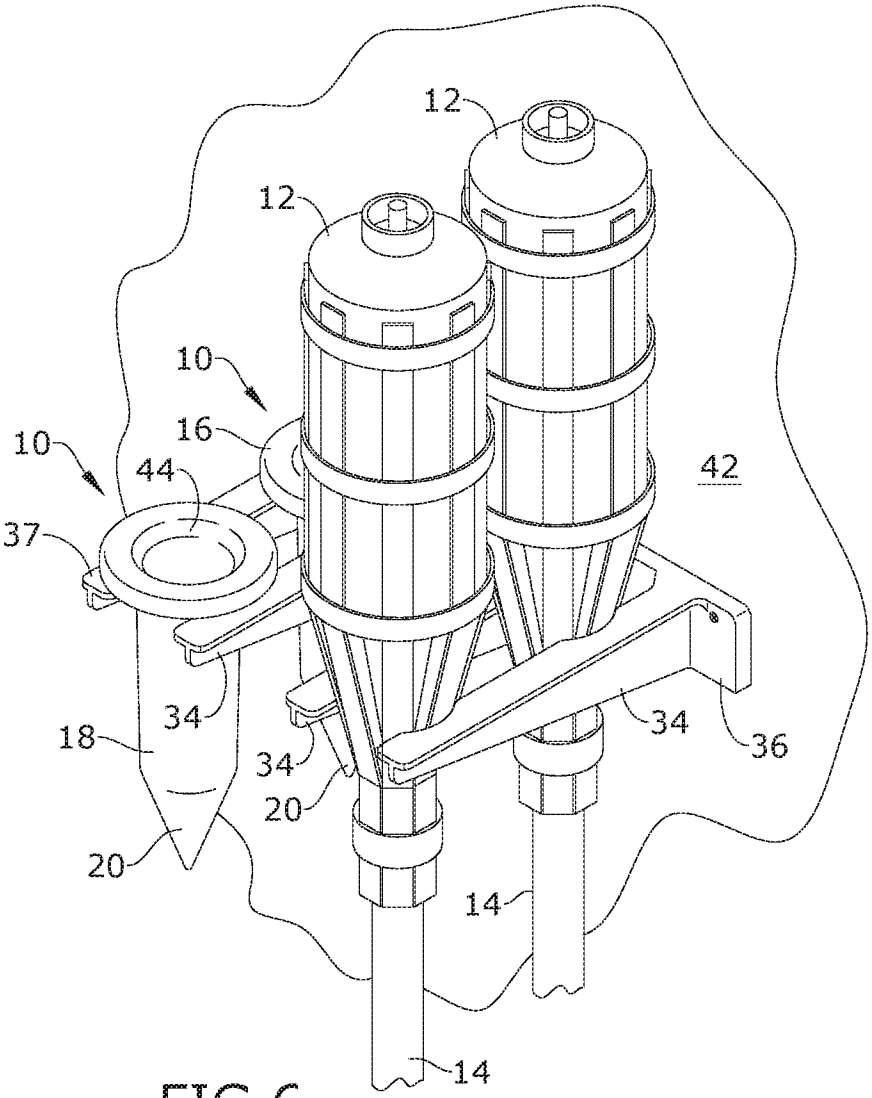
FIG. 6 is a perspective view of an exemplary embodiment of the present invention, showing the lateral storage holder in use.
Figure 5:
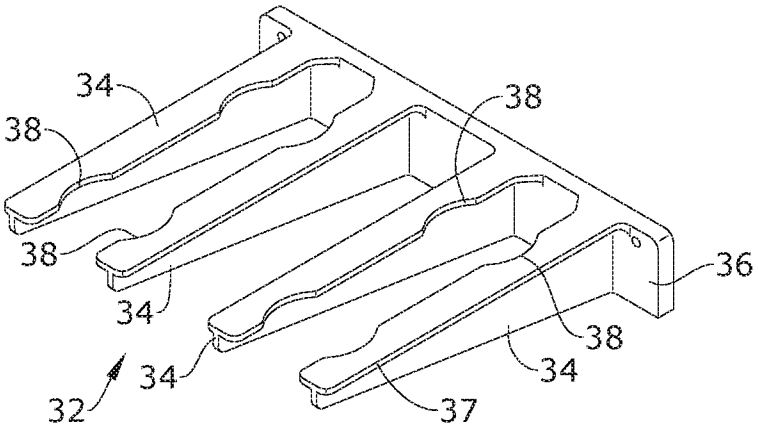
FIG. 5 is a perspective view of an exemplary embodiment of a lateral storage holder of the present invention.
Figure 7:
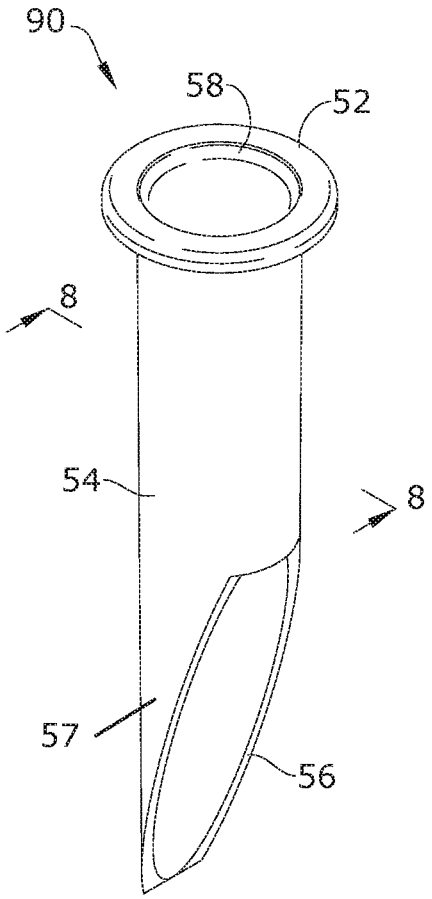
FIG. 7 is a perspective view of an exemplary embodiment of an in-use torch holder of the present invention.
Figure 8:
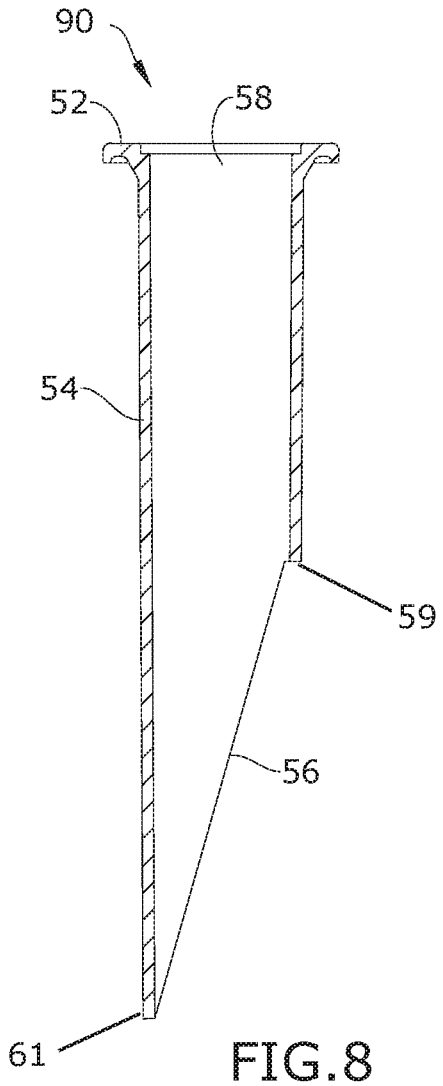
FIG. 8 is a cross-sectional view of an exemplary embodiment of the in-use torch holder of the present invention taken along line 8-8 of FIG. 7.
Figure 9:
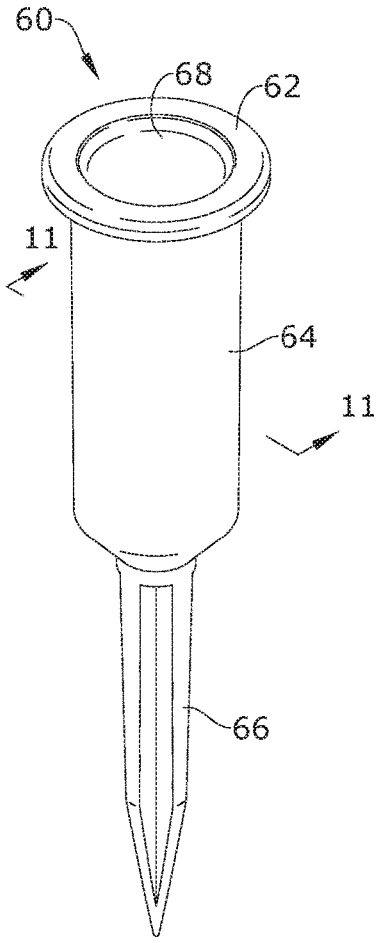
FIG. 9 is a top perspective view of an exemplary embodiment of an in-use torch holder of the present invention.
Figure 10:
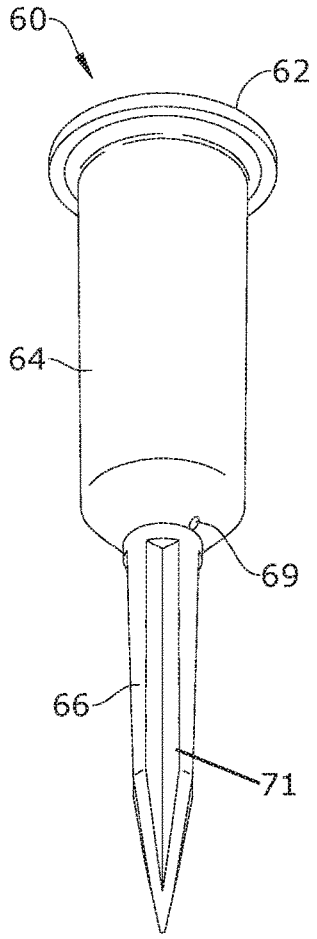
FIG. 10 is a bottom perspective view of an exemplary embodiment of the in-use torch holder of the present invention.
Figure 11:
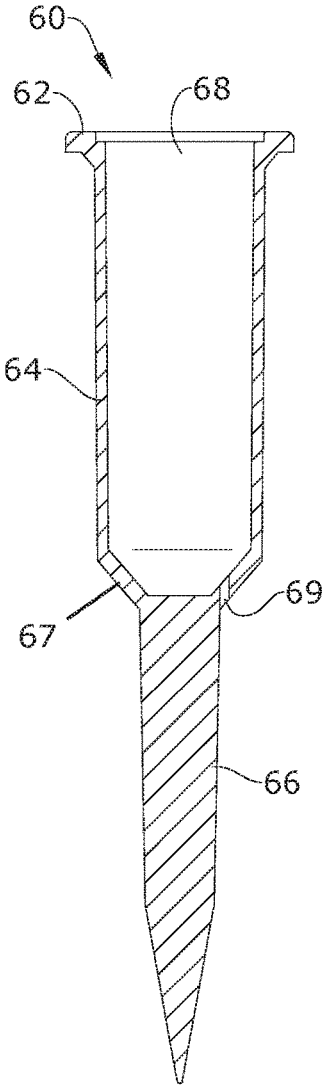
FIG. 11 is a cross-sectional view of an exemplary embodiment of the in-use torch holder of the present invention taken along line 11-11 of FIG. 9.
Figure 12:
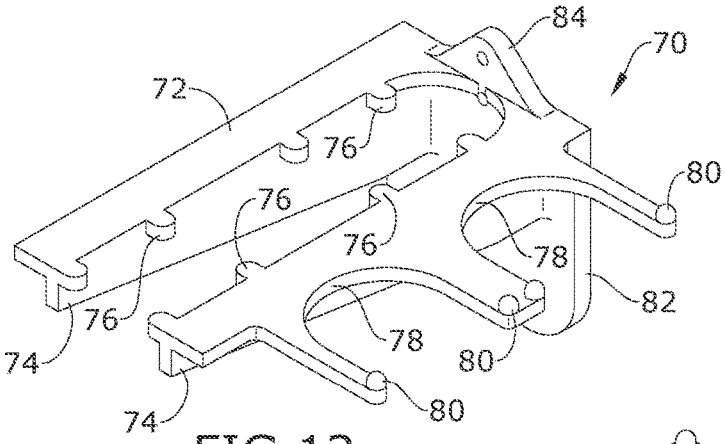
FIG. 12 is a front perspective view of an exemplary embodiment of a rack storage holder of the present invention.
Figure 13:
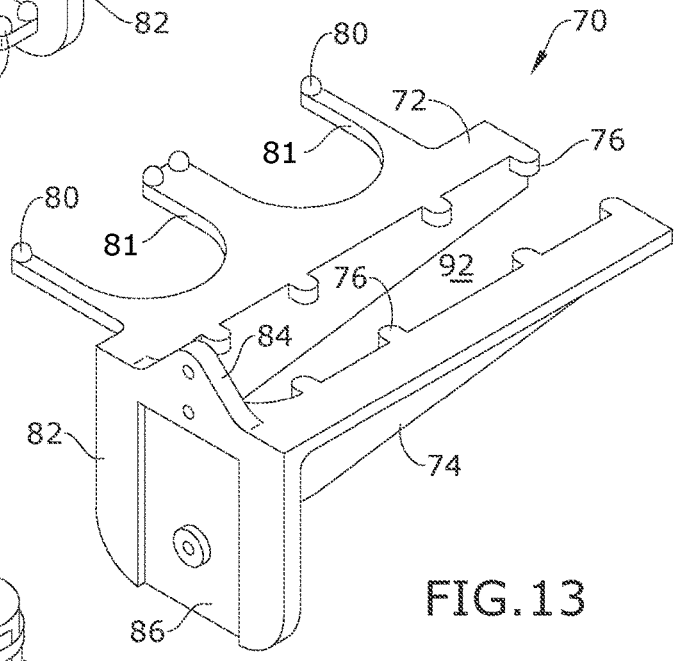
FIG. 13 is a rear perspective view of an exemplary embodiment of the rack storage holder of the present invention.

The lateral torch holder 32 may provide a plurality of lateral arms 34 and extending generally perpendicularly from the planar mounting component 36, as illustrated in FIG. 5. each lateral arm 34 may provide an upper flange 37 perpendicularly extending from an upper portion thereof, each upper flange 37 may provide u-shaped lateral notches 38 oriented to align and face u-shaped lateral notches 38 on adjacent lateral arms 34, as illustrated in FIG. 5. thereby these pairs of aligned lateral notches 38 are dimensioned and adapted to engage opposing sides of the conic base 50 of the torch 12 or snugly engage the outer sidewalls of the cylindrical portion 18 of the first torch holder for removably retaining said torch 12 and said first torch holder 10 in a stored condition, as illustrated in FIG. 6.

In a third embodiment of the storage torch holder, a rack holder 70 may provide a mounting component 82 from which transversely extends two or more rack arms 74. A top plate 72 may be perpendicularly joined to a top portion of the rack arms 74.

From between adjacent rack arms 74, a first void 92 may be cut from the top plate 72. From the top plate 72 a plurality of torch slots 78 may be cut where the top plate 72 extends not between adjacent rack arms 74. The torch slots 78 may be generally half-circular in shape, thereby defining lateral supports 81. A distal end of the lateral supports 81 may provide upward-facing torch holding nubs 80. The torch slots 78 may be dimensioned and adapted to slidably engage opposing sides of the conic base 50 of the torch 12 or snugly engage the outer sidewalls of the cylindrical portions 18, 54, or 64. Likewise, the first void 92 may provide inward-facing, spaced-apart stake holding nubs 76 so as to define a plurality of slots dimensioned and adapted to slidably engage opposing sides of the conic base 50 of the torch 12 or snugly engage the outer sidewalls of the cylindrical portions 18, 54, or 64.

The mounting component 82 may provide a hanger plate 84 from the top thereof. The mounting component 82 may provide a mounting surface 86 for operatively associating with a vertical surface mounted component (not shown).

A method of using the present invention may include the following. The in-use torch holders 10, 60 and 90 as well as the upward, lateral, and rack torch holders 24, 32 and 70 disclosed above may be provided. A user desiring to plant a garden torch 12 in an operable condition may place the in-use torch holder with the tip portion 20 or 57 or spike 66 pointed downwardly, and carefully step on the flange 16, 52 or 62 until the in-use torch holder 10, 60 or 90 is firmly secured in the horizontal supporting surface 40 to approximately the flange end. Then the user may plant the torch 12 into the first torch holder 10 through its opening 44, 58 or 68, typically until the shaft 14 engages the ribs 22 of the tip portion 20 or is otherwise secured in the body portion 18, 54, or 64. The first torch holder 10 is adapted to not wear out, and may be ready to be pulled up to move the torch 12 or store them.

Figure 14:
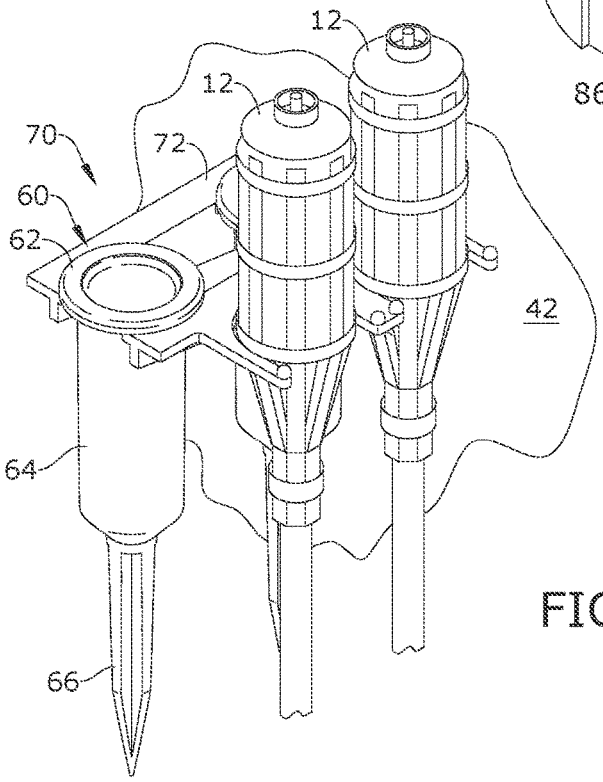
FIG. 14 is a perspective view of an exemplary embodiment of the present invention, showing the rack storage holder in use.

When the user wishes to move the torch 12 to a stored condition, the user may secure either of the upward, lateral or rack torch holders 24, 32 and 70 against the vertical supporting surface 42 by using fasteners through the respective mounting component 26, 36 or 82. Then the user can support both the torch 12 and its in-use torch holder 10, 60 or 90 by placing each in engagement with a pair of aligned upward-facing notches 30, a pair of aligned lateral notches 38, between a pair of stake holding nubs 76, in a torch slot, and/or on a protrusion 28, as illustrated in FIGS. 4, 6 and 14. The in-use, upward, lateral and rack torch holders 10, 60, 90, 24, 32, 70 may be a kit.

It should be understood, of course, that the foregoing relates to exemplary embodiments of the invention and that modifications may be made without departing from the spirit and scope of the invention as set forth in the following claims.

What is claimed is:

1. A kit for holding garden torches in a vertical supporting surface and a horizontal supporting surface, comprising:

a rack torch holder comprising:

a mounting portion;

a plurality of rack arms extending from the mounting portion;

a top plate perpendicularly joined along a top portion of each rack arm;

a first void in the top plate between adjacent rack arms;

the first void provides inward-facing, spaced-apart stake holding nubs so as to define a plurality of slots; and a plurality of torch slots provided along a portion of the top plate that extends away from the plurality of rack arms, wherein each torch slot is dimensioned to slidably receive a conical base portion of a garden torch.

2. The kit of claim 1, wherein each torch slot is defined by two spaced apart lateral supports.

3. The kit of claim 2, further comprising an upward-facing torch holding nub at a distal end of each lateral support.

4. The kit of claim 1, wherein a top portion of the mounting portion provides a hanger plate.

* * * * *